United States Patent [19]

Vidalin

[11] 4,006,526

[45] Feb. 8, 1977

[54] ELECTRIC COMMUTATOR-SWITCH AND METHOD FOR ASSEMBLING IT

[75] Inventor: Jacques Marie Vidalin, Bordeaux, France

[73] Assignee: Phoebe S. A., Fribourg, Switzerland

[22] Filed: May 27, 1975

[21] Appl. No.: 580,581

[30] Foreign Application Priority Data

May 27, 1974 France ..... 74.19451

[52] U.S. Cl. ..... 29/622; 200/67 G

[51] Int. Cl.[2] ..... H01H 11/00

[58] Field of Search ..... 200/67 G, 68, 6 BA, 200/6 BB, 6 C; 29/622

[56] References Cited

UNITED STATES PATENTS

| | | | |
|---|---|---|---|
| 3,711,663 | 1/1973 | Sorenson | 200/67 G |
| 3,931,487 | 1/1976 | Russenberger | 200/6 BA |

*Primary Examiner*—David Smith, Jr.

[57] ABSTRACT

The central element of the tumbler is hollowed to receive a hollow spring element and a piston whose ends are similar and symmetrical. One of the ends of the piston cooperates with the spring element and the other end cooperates with a contact forming element. The piston is bored with an axial groove.

2 Claims, 7 Drawing Figures

Fig.1.
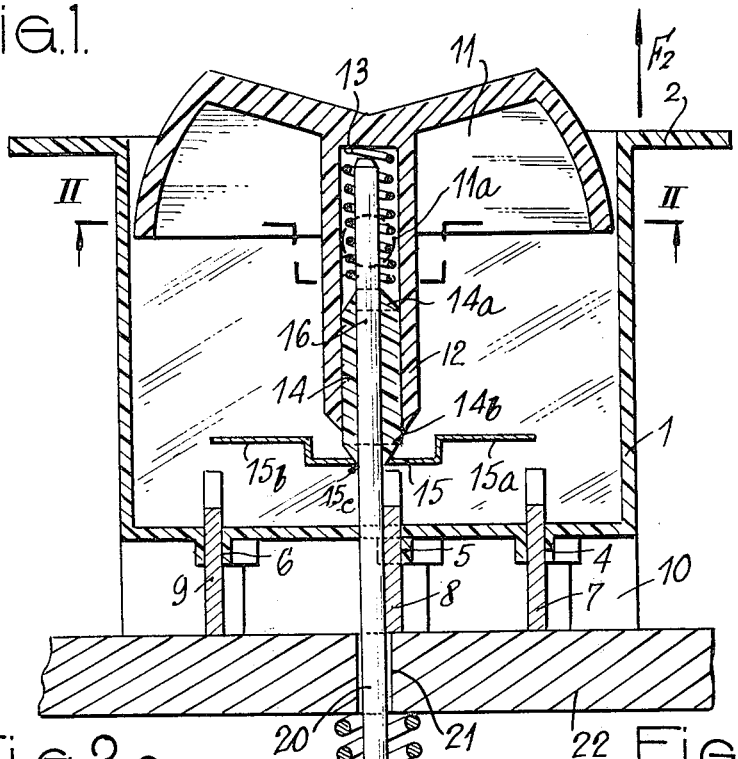
Fig.2a.
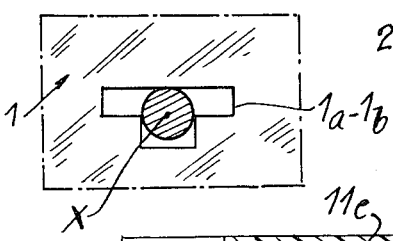
Fig.2b.
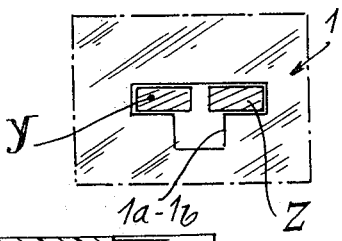
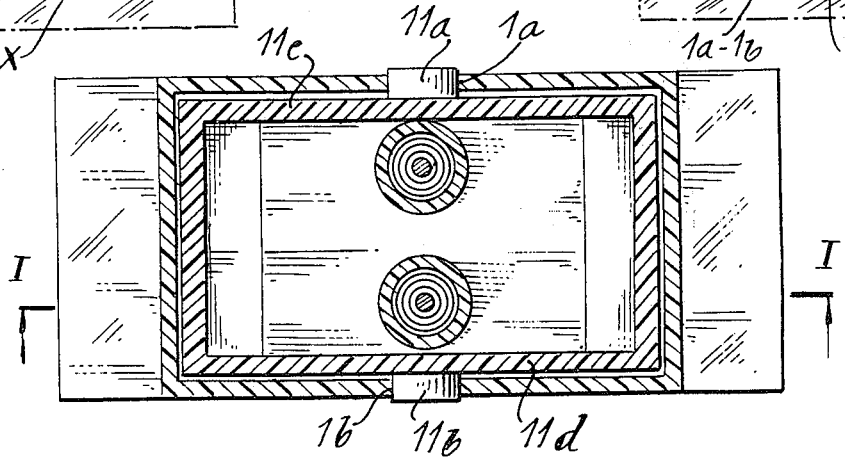
Fig.2.

ELECTRIC COMMUTATOR-SWITCH AND METHOD FOR ASSEMBLING IT

The present invention relates to a small electric commutator-switch usually used in control panels of automatic machines and similar apparatus, and having to open a first circuit and then close a second circuit, thus switching over an energy from the first to the second circuit. It is often difficult to make such small size switches because these components are very small and consequently require a skilled labor, which is very costly and has a generally rather low output.

The present invention copes with these disadvantages by creating a commutator-switch having a limited number of parts and of which the method for assembling it is very fast, even when made by not skilled people, which reduces costs.

According to the invention, the switch comprises a tumbler having a central component of such a shape that the resilient element and the contact blade are directly placed on it without any risk of error.

According to another feature of the present invention, the central component of the tumbler is hollowed to receive a hollow spring element and a piston having two identical and symmetrical ends, one of the two ends cooperating with the spring element, and the other one of the two ends cooperating with a contact forming element, the piston being axially bored with a groove to receive an element facilitating assembling of the switch.

Various other features of the invention are moreover shown in the following detailed description.

An embodiment of the invention is shown by way of example in the accompanying drawing, wherein:

FIG. 1 is a cross sectional elevation view, taken substantially along line I—I of FIG. 2, of a commutator-switch according to the invention during assembling.

FIG. 2 is a cross sectional view, taken along line II-II of FIG. 1.

FIGS. 2*a*, 2*b* are elevations, partially in cross section, showing a construction detail of the switch.

Figure 3:
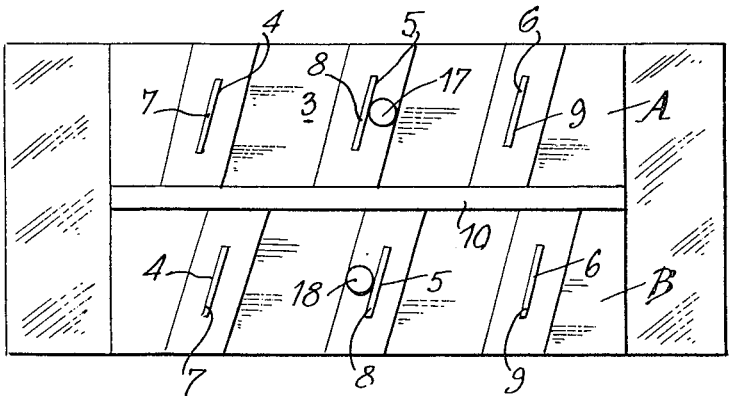
Figure 4:
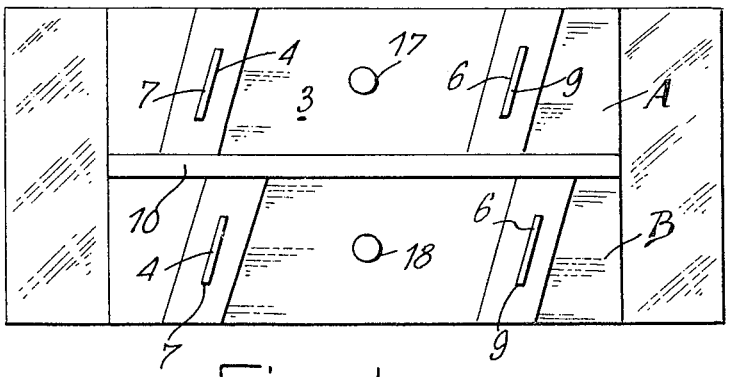
Figure 5:
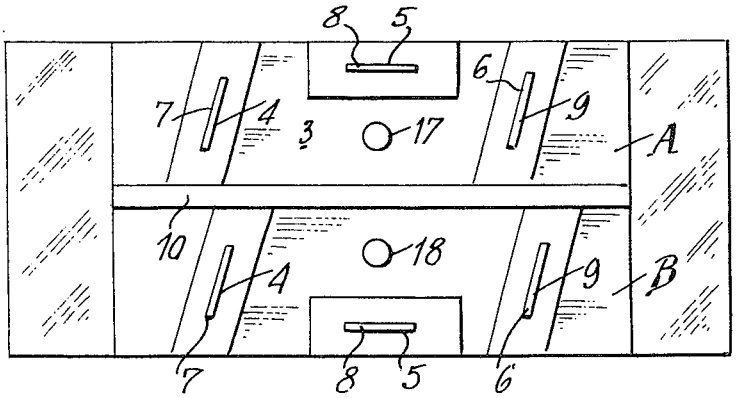

FIGS. 3, 4 and 5 are plane bottom views of the switch.

In FIG. 1, the switch is constituted of a casing 1, parallelepipedic in shape, and exhibiting a peripheral edge 2 at one of its ends. The bottom 3 of the casing 1 has openings 4, 5, 6, provided to receive pins 7, 8, 9, on which are placed the electric leads. A central plate 10 separates, when double-pole switches are concerned, the left pins from the right pins of the switch. A tumbler 11 is provided which comprises, in its center, sleeves 12. Each sleeve 12 contains a helicoidal spring 13 and a piston 14 of which both ends 14*a*, 14*b* are perfectly identical and symmetrical and are, each of them, constituted by a tapered or spherical portion. On the end 14*b*, there is placed a slightly resilient blade 15, said blade being centrally U-shaped and having arms 15*a*, 15*b*, extending the wings of the central U and which are normally in contact with at least two of the above mentioned pins 7, 8, 9. This blade 15 has, in the center thereof, a hole 15*c* which will enable introduction of the rod 20 as described below.

The piston 14 is bored in its center with a groove 16. Besides, the bottom 3 of the casing 1 comprises openings 17, 18 provided either in its central area, or in the longitudinal median axis of the two portions A, B (FIGS. 3 – 5) separated by the plate 10, and substantially at equal distance from the lateral edges of the bottom 3; the openings 17, 18 enabling introduction of at least one rod 20 passing through a groove 21 of a table 22 on which bears the casing 1 through the pins 7, 8, 9.

The rod 20 can vertically slide through the groove 21, bored in the table 22, since it is fixed at one of the ends of a spring 24 of which the other end is fixed to the bottom of the table 22. The rod 20, thus, receives at each time upon assembling of a switch: a casing 1, a blade 15, a piston 14, then the hollow spring element 13, and lastly the tumbler 11 of which, as shown in FIG. 2, the lateral sides 11*c*, 11*d* support pins 11*a*, 11*b* which are housed into holes 1*a*, 1*b* designed in the lateral side walls of the casing 1. The holes 1*a* and 1*b* have a particular T-shape to receive either a tumbler rotating on its axis X or a tumbler sliding between two positions Y and Z, as respectively shown in FIGS. 2*a* and 2*b*.

At this time, the switch is thus quickly assembled, without any risk of error, since each part thereof has been centered on the rod 20.

In case where double-pole switches are manufactured, as in the case shown in FIGS. 1 – 3, two rods placed side-by-side on the table 22, can go through holes 17, 18 of the bottom of the casing 1.

Due to the fact that the rod 20 can slide vertically on some distance, there is no chance to damage the parts constituting the switch, since if people in charge of assembling will press, during handling, too strongly on one of the parts, the rod 20 will be lowered in the direction of the arrow $F_1$ (FIG. 1) against action of the spring 24.

When the switch is completely assembled, it suffices to raise it upwards in direction of the arrow $F_2$ (FIG. 1) to remove it from the rod 20.

In FIGS. 4 and 5, there have been respectively shown a double-pole switch (FIG. 4) and a double pole, double-throw switch (FIG. 5), but with the central terminals being off-set by 90°, which makes easier the centering of the holes 17, 18 enabling thereby an easy placing of the rods 20 upon the assembling. Yet, in the case of FIG. 3, the rods 20 are sufficiently flexible to enable a correct mounting even if the holes 17, 18 are slightly off-centered. The holes 17 and 18 can have a diameter slightly larger than the rod 20 to let the rod 20 to pass through the holes 17 and 18 slightly oblically in a view of passing through the pins 11*a*, 11*b* for a correct assembling of the tumbler.

The mobile blade 15 is U-shaped, the width between the vertical arms of the U depending on the width of the sleeves 12 forming small columns for either the rotating tumbler or the sliding tumbler.

In all the cases the blade 15 constitutes a sliding, U-shaped and self-cleaning contact.

The switch being rotated in either of the end positions putting-on a circuit in which the switch is placed, it can sometimes happen, in case of over current, a slight contact sticking between the mobile blade and the terminal. In such a case, if the tumbler is operated to make the blade 15 move on the other pair of terminals, the outer side of the small column 12 of the tumbler 11 will bear on the inner side of the vertical branch of the U of the blade 15 and will ensure, by a direct and positive action, the off-set and the opening of the circuit.

I claim:

1. A method of assembling an electrical switch of the type having a casing carrying a plurality of contacts, a movable blade contact, a plunger for moving the blade contact into and out of contact with the casing contacts, a resilient element urging the plunger against the blade contact, and a tumbler having means for receiving the plunger and resilient element and for moving the plunger and resilient element therewith, said method comprising the steps of:

providing a work base with a pin projecting upwardly therefrom;

inserting said casing over said pin with said pin protruding through a hole in the bottom of said casing;

inserting said blade contact over said pin with said pin protruding through a hole in said blade contact;

inserting said plunger over said pin with said pin protruding through an axial hole in said plunger;

inserting said resilient element over said pin with said pin protruding into an axial hole in said resilient element;

inserting said tumbler over said plunger and resilient element with said plunger and resilient element received in said receiving means; and removing the assembled casing, blade contact, plunger, resilient element and tumbler from said pin.

2. The method as claimed in claim 1 for assembling a multipole electrical switch, wherein:

said providing step includes providing a plurality of said pins projecting upwardly from said work base;

said casing inserting step includes inserting said casing over said plurality of pins with said plurality of pins protruding through a corresponding plurality of holes in the bottom of said casing;

said blade contact, plunger, and resilient element inserting steps include inserting a separate blade contact, plunger, and resilient element over each of said plurality of pins; and said tumbler inserting step includes inserting said tumbler over said plunger and resilient elements with said plurality of plungers and resilient elements received in a corresponding plurality of said receiving means in said tumbler.

* * * * *